US009977373B2

(12) United States Patent
Chun et al.

(10) Patent No.: US 9,977,373 B2
(45) Date of Patent: May 22, 2018

(54) PATTERN FOIL PRINTING

(71) Applicant: HEWLETT-PACKARD DEVELOPMENT COMPANY LP, Fort Collins, CO (US)

(72) Inventors: Doris Chun, Palo Alto, CA (US); Yaron Grinwald, Nes Ziona (IL); Reut Avigdor, Nes Ziona (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 37 days.

(21) Appl. No.: 14/912,147

(22) PCT Filed: Aug. 13, 2013

(86) PCT No.: PCT/US2013/054710

§ 371 (c)(1),
(2) Date: Feb. 15, 2016

(87) PCT Pub. No.: WO2015/023262

PCT Pub. Date: Feb. 19, 2015

(65) Prior Publication Data

US 2016/0195836 A1 Jul. 7, 2016

(51) Int. Cl.
*G03G 15/16* (2006.01)
*G03G 15/01* (2006.01)
(Continued)

(52) U.S. Cl.
CPC ..... *G03G 15/1605* (2013.01); *G03G 15/0131* (2013.01); *G03G 15/0189* (2013.01);
(Continued)

(58) Field of Classification Search
CPC ..... G03G 15/1605; G03G 15/0131; G03G 2215/00502; G03G 15/0189; G03G 15/10;
(Continued)

(56) References Cited

U.S. PATENT DOCUMENTS 4,868,049 A 9/1989 Nelson
5,926,679 A * 7/1999 May ..... G03G 15/0131 399/231
(Continued)

FOREIGN PATENT DOCUMENTS

CN 1942317 4/2007
EP 0838346 4/1998
(Continued)

OTHER PUBLICATIONS

International Search Report, PCT/US2013/054710, dated May 22, 2014, 6 pages.
(Continued)

*Primary Examiner* — Rodney Bonnette
(74) *Attorney, Agent, or Firm* — HP Inc. Patent Department

(57) ABSTRACT

A printer includes an image formation portion, a feed portion, and a transfer portion. The image formation portion transfers formed first and second patterned marking agent layers from a photoconductor member onto an intermediate transfer member. The feed portion directs a portion of a foil layer to become adhered, according to the pattern, onto the first marking agent layer on the intermediate transfer member before the second marking agent layer is transferred onto, and becomes adhered to, the foil portion. The transfer portion causes transfer of the foil portion from the intermediate transfer member, via transfer of at least the second marking agent layer from the intermediate transfer member, onto a substrate.

18 Claims, 9 Drawing Sheets

(51) Int. Cl.
*G03G 15/22* (2006.01)
*G03G 15/00* (2006.01)
*G03G 15/10* (2006.01)

(52) U.S. Cl.
CPC ..... *G03G 15/10* (2013.01); *G03G 15/225* (2013.01); *G03G 15/6585* (2013.01); *B42D 2033/10* (2013.01); *G03G 2215/00502* (2013.01)

(58) Field of Classification Search
CPC ..... G03G 15/225; G03G 15/6585; B42D 2033/10
See application file for complete search history.

(56) References Cited

U.S. PATENT DOCUMENTS 6,916,583 B1 * 7/2005 Landa ..... B41M 7/00 264/175
8,417,171 B2 4/2013 Christopher et al.
2007/0222207 A1 * 9/2007 Hendry ..... G09F 3/02 283/101
2008/0271836 A1 11/2008 Richter et al.
2008/0317518 A1 * 12/2008 Fukuhara ..... G03G 15/1695 399/302
2009/0173244 A1 7/2009 Song
2009/0250522 A1 10/2009 Williams et al.
2010/0051165 A1 3/2010 Tombs et al.
2010/0086753 A1 * 4/2010 Johnson ..... B41M 3/00 428/203
2010/0104336 A1 4/2010 Christopher et al.
2010/0202789 A1 * 8/2010 Kimura ..... G03G 15/50 399/39
2012/0141665 A1 6/2012 Kim et al.
2012/0156609 A1 * 6/2012 Matsushima ..... G03G 15/1605 430/124.1
2012/0177417 A1 * 7/2012 Fujita ..... G03G 15/1625 399/297
2013/0000830 A1 1/2013 Green

FOREIGN PATENT DOCUMENTS

JP 2001042650 2/2001
JP 2011520650 7/2011

OTHER PUBLICATIONS

Nishi, Direct Metal Patterning by Inkjet Technology, Konicaminolta IJ Technologies, Inc., 2007 IEEE, p. 297.

* cited by examiner

PATTERN FOIL PRINTING

CROSS-REFERENCE TO RELATED APPLICATIONS

This Utility Patent Application is a U.S. National Stage filing under 35 U.S.C. § 371 of PCT/US2013/054710, filed Aug. 13, 2013, incorporated by reference herein.

BACKGROUND

While most printing involves inks and toners, people have become attracted to placement of metallic elements on printed products. For example, some business cards or writing utensils (e.g. pencils) may include a foil portion that is stamped onto or otherwise secured to the article after other printing occurs on the article.

DETAILED DESCRIPTION

Figure 1:
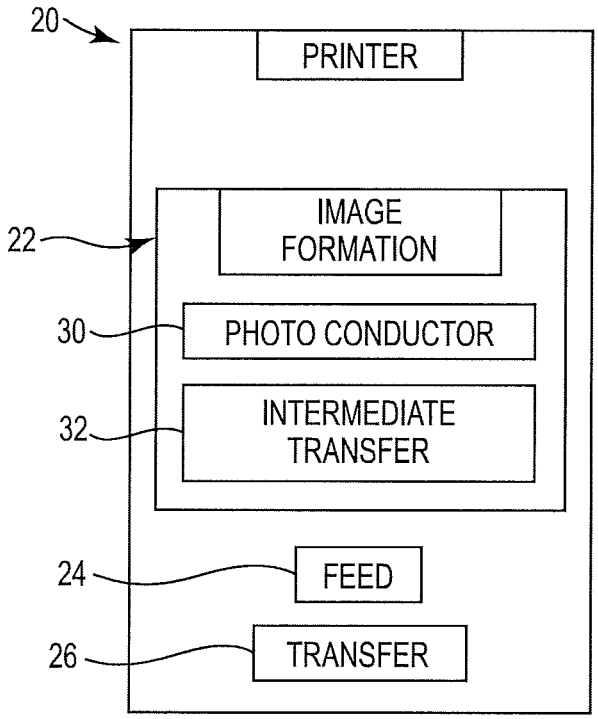
FIG. 1 is a block diagram schematically illustrating a printer, according to one example of the present disclosure.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense.

At least some examples of the present disclosure are directed to digital printing of conductive and/or metallic foil elements such that the application of the conductive and/or metallic foil elements occurs as part of the printing process and not as part of a post-printing operation as occurs in traditional techniques.

In some examples, this digital printing of conductive and/or metallic foil elements occurs as part of a liquid electrophotography printing process. In other words, instead of adding a conductive element to a substrate after printing of an image has already occurred onto the substrate (as may occur in other systems), at least some examples of the present disclosure incorporate transfer of the conductive element onto the substrate as part of the printing process.

In some examples, the conductive and/or metallic foil elements are added onto an intermediate transfer member of a liquid electrophotography press between otherwise successive layers of ink transferred onto the intermediate transfer member from a photoconductor member.

In particular, to achieve a particular pattern (including a desired shape, size, and location) of foil elements on a substrate, a first ink layer is first imaged according to a desired pattern on the photoconductor member and transferred onto the intermediate transfer member. Thereafter, by contacting a top coating layer of an unpatterned sheet of a foil assembly against the first ink layer (during rotation of the intermediate transfer member), select portions of the foil assembly become adhered to the first ink layer while other portions of the foil assembly do not become adhered to the first ink layer. Instead, these other portions remain positioned on the supply sheet of foil assembly and do not become part of the printed product. Typically, they are discarded or recycled separately from the printing process in the examples of the present disclosure.

In one aspect, the adhered portion(s) of the foil assembly match the pattern of the first ink layer.

A subsequent second ink layer is transferred onto the portions of the foil assembly on the intermediate transfer member with the second ink layer having a pattern that at least covers the pattern of the first ink layer and the adhered portion(s) of the foil assembly on the intermediate transfer member. In some examples, the pattern of the second ink layer identically matches the pattern of the first ink layer.

In some examples, this digital printing of conductive and/or metallic foil elements is implemented via laser-based dry toner systems. However, in these examples, toner is fused to the substrate (e.g. paper) in an initial step, which is then followed by transfer of portions of the foil assembly via adhesion to re-melted toner on the transfer member. In some examples, the substrate is a non-meltable substrate suitable to withstand the high heat used (in dry toner systems) to fuse the toner to the substrate.

In at least some examples of the present disclosure, foil portions printed onto a substrate are hidden from view because they underlie at least one opaque ink layer. In some examples, such hidden foil portions are usable for advertising, transactional, security purposes, etc. In at least some examples, foil printed portions serve as holographic components used in fraud and counterfeit protection solutions.

On the other hand, in at least some examples, foil portions printed onto a substrate are at least partially visible because they underlie transparent or translucent patterned ink layer(s) and thereby enhance the appearance of a printed article. For example, via these in-line foil printing examples, a graphic image may incorporate a high brilliance metallic portion or image that is visible through the transparent or translucent ink layer.

Printing foil portions via at least some examples of the present disclosure, such as via liquid electrophotography, provides significant cost savings and enables high throughput production of printed particles whereas other attempts at conductive materials printing, such as drop-on-demand printing, involve relatively higher cost and lower volume production.

In some examples, transfer of the conductive elements onto a substrate to become part of a printed product is performed at generally the same time as, and using the same printing components (e.g. photoconductor member, intermediate transfer member, etc.) that is used to print an image onto the same substrate that carries the conductive element. By doing so, the conductive element effectively forms part of the printed image, instead of being merely added afterwards, as occurs in traditional systems and processes. Accordingly, in at least some examples, no separate post-printing apparatus is used to incorporate the conductive element as part of the printed image on the substrate.

These examples, and additional examples, are further described and illustrated in association with at least FIGS. 1-13.

FIG. 1 is block diagram schematically illustrating a printer 20, according to one example of the present disclosure. As shown in FIG. 1, in some examples, printer 20 includes an image formation portion 22, a feed portion 24, and transfer portion 26. In some examples, the image formation portion 22 includes a photoconductor member 30 and an intermediate transfer member 32, such as when printer 20 comprises a liquid electrophotography press.

In one aspect, the image formation portion 22 acts to form a first patterned ink layer on the photoconductor member 30 (e.g. a drum or belt) and then transfer that first patterned ink layer onto the intermediate transfer member 32. At a later point in time, the image formation portion 22 further acts to form a second patterned ink layer on the photoconductor member 30, which is then transferred to the intermediate transfer member 32. In some examples, each of the respective first and second patterned ink layers forms the same pattern. In some examples, the second ink layer has a shape and size to at least cover the first ink layer and also cover additional areas of the substrate not covered by the first ink layer.

In some examples, the feed portion 24 of printer 20 acts to direct select portion(s) of a conductive foil layer to become adhered, according to the pattern, onto the first patterned ink layer on the intermediate transfer member. The second patterned ink layer is later transferred onto, and becomes adhered to, the foil portion according to the pattern. As further described later in association with at least FIG. 12, a control portion controls the timing sequence of formation and transfer of the first and second ink layers relative to transfer of a foil portion on the intermediate transfer member.

In some examples, the transfer portion 26 acts to cause transfer of the foil portion from the intermediate transfer member 32, via transfer of at least the second ink layer from the intermediate transfer member 32, onto a substrate.

Further details regarding the structure and operation of a printer, and details regarding transfer of a conductive or foil element onto a substrate, in accordance with examples of the present disclosure is provided below in association with at least FIGS. 2-13.

Figure 2:
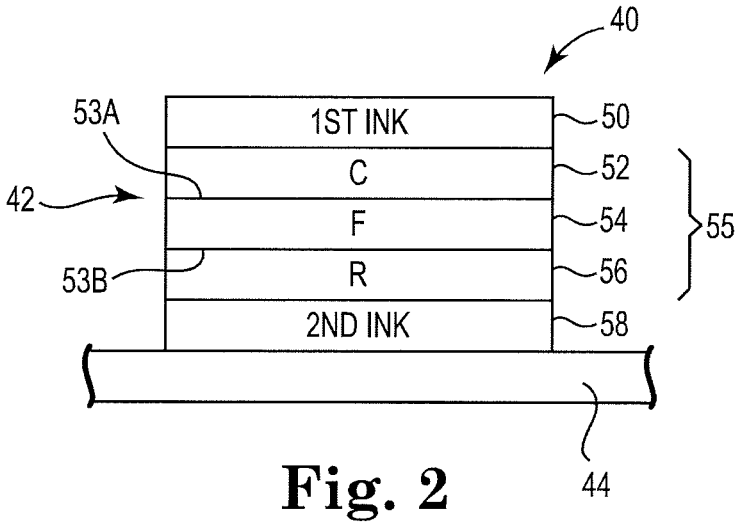
FIG. 2 is a side view schematically illustrating at least a portion of a printed product, according to one example of the present disclosure.

FIG. 2 is a side view of a printed product 40, according to one example of the present disclosure. In some examples, printed product 40 is produced via printer 20 and/or one of the printers described later in examples of the present disclosure. The printed product 40 includes a foil layer 54. In some examples, foil layer 54 comprises a metallic conductive material while in some examples, foil layer 54 need not be conductive but has a metallic appearance. In some examples, the foil layer 54 is conductive but does not necessarily have a metallic appearance.

In some examples, as shown in FIG. 2, at least a portion of a printed product 40 includes a first ink layer 50 adhered relative to a first side 53A of the foil layer (F) 54 and a second ink layer adhered relative to an opposite second side 53B of the foil layer 54. In some examples, the foil layer 54 comprises part of a foil assembly 55 including a coating layer (C) 52 on the first side 53A of the foil layer 54 and a release layer (R) 56 on the second side 53B of the foil layer 54. In these examples, the coating layer 52 is interposed between the first ink layer 50 and the first side 53A of the foil layer 54 and the release layer (R) 56 is interposed between the second ink layer 58 and the second side 53B of the foil layer 54.

In one aspect, as shown later in association with at least FIG. 5, prior to incorporation into printed product 40, the foil assembly 55 further includes a backing layer releasably secured to the release layer 56.

While not visible from the side view of FIG. 2, the various layers 50-58 have generally the same pattern on the substrate according to the desired image to be printed on substrate 44.

In some examples, each ink layer 50, 58 is formed from a marking agent such as an ink comprising charged pigmented particles in a liquid carrier, such as but not limited to ElectroInk® available from Hewlett-Packard. In some examples, the marking agent is a toner or other type of ink having adhesive properties suitable for adhering to foil elements and for adhesion and release from a blanket of an intermediate transfer member.

Finally, it will be understood that the thickness of layers 50-58 as shown in FIG. 2 are exaggerated (relative to the thickness of substrate 44) for illustrative purposes and do not necessarily represent a true scale of thicknesses of layers 50-58 relative to each other or relative to the substrate.

Figure 3:
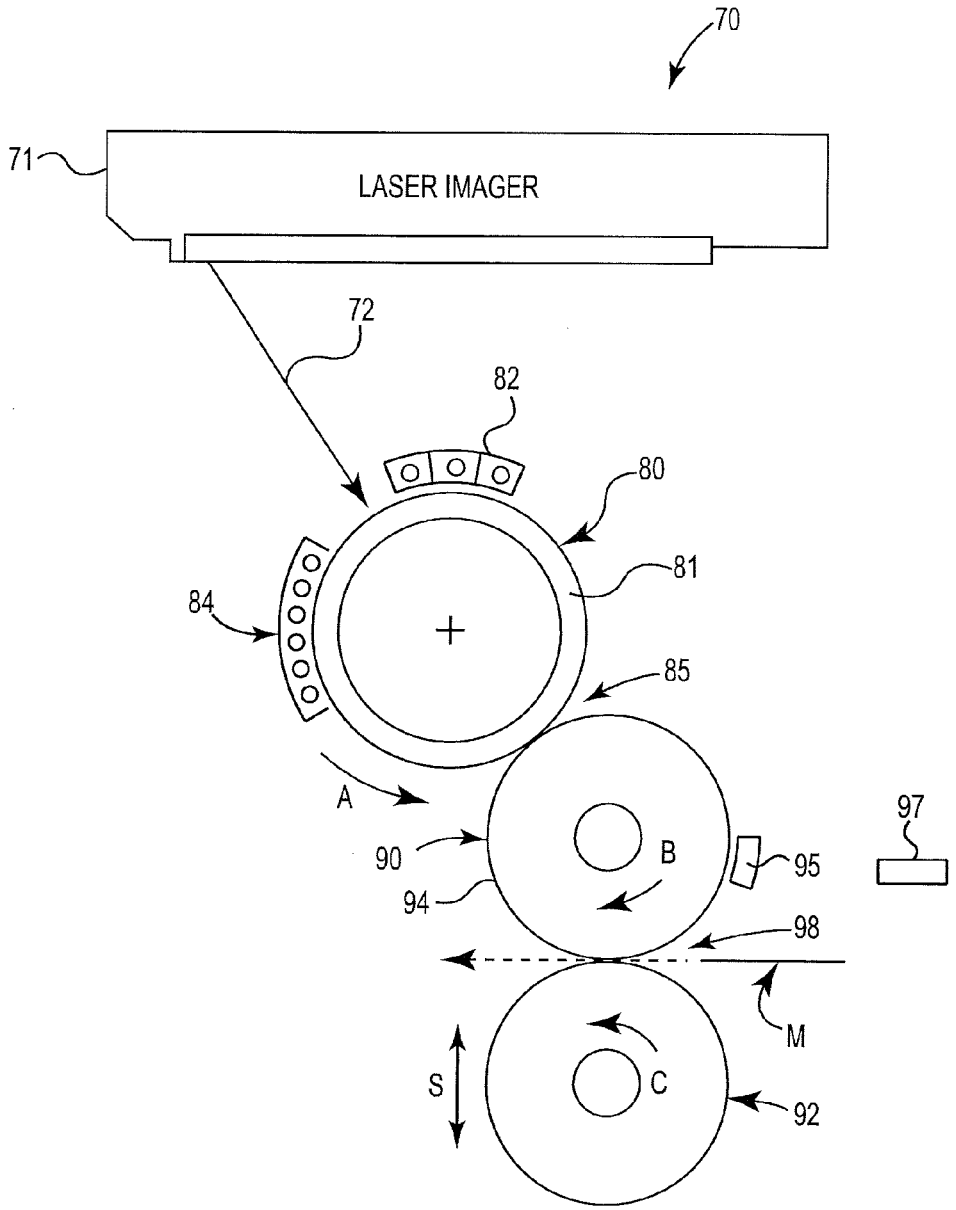
FIG. 3 is a diagram schematically illustrating a side view of a printer, according to one example of the present disclosure.

FIG. 3 is a side view schematically illustrating a printer, according to one example of the present disclosure. In some examples, printer 70 includes at least some of the substantially the same features and attributes as printer 20, as previously described in association with FIG. 1. In some examples, printer 70 comprises a liquid electrophotography press.

As shown in FIG. 3, printer 70 comprises a laser imager 71, an imaging member 80 (e.g. a photoconductor drum or belt), a transfer member 90, and an impression member 92. In some examples, each of the respective members 80, 90, 92 comprise a rotatable cylinder or drum.

In addition, the printer 70 comprises a charging station 82 and a developing station 84. In one aspect, the imaging member 80 includes an outer electrophotographic surface or plate 81 while the transfer member 90 includes an outer surface 94 defined by a blanket.

While not shown in FIG. 3, in other embodiments the printer 70 additionally comprises excess ink collection mechanisms, cleaners, additional rollers, and the like as familiar to those skilled in the art. A brief description of the operation of the printer 70 follows.

In preparation to receive an image, the imaging member 80 receives a charge from charging station 82 (e.g., a charge roller or a scorotron) in order to produce a uniform charged surface on the electrophotographic surface 81 of the imaging member 80. Next, as the imaging member 80 rotates (as represented by directional arrow A), the laser imager 71 projects an image via beam 72 onto the surface 81 of imaging member 80, which discharges portions of the imaging member 80 corresponding to the image. In other words, the discharged portions form a negative pattern corresponding to the image to be printed. These discharged portions are developed with ink via developing station 84 to "ink" the image. As imaging member 80 continues to rotate, the image is transferred at nip 85 onto the electrically biased blanket 94 of the rotating transfer member 90. Rotation of the transfer member 90 (as represented by directional arrow B), in turn, transfers the ink image onto media M passing through the pressure nip 98 between transfer member 90 and impression member 92.

In some examples, printer 70 includes a heater 95 positioned adjacent the transfer member 90 between the imaging member 80 and the impression member 92 to heat the blanket of the transfer member 90 and/or layers on blanket of the transfer member 90 as further described later in the present disclosure. In some examples, heater 95 is omitted or not activated during a particular printing operation.

In some examples, printer 70 includes a feed station 97 to feed a substrate and/or other elements, such as a sheet of foil assembly or conductive elements to interact with intermediate transfer member 90 as part of forming a printed product according to at least some examples of the present disclosure. In some examples, feed station 97 includes at least substantially the same features and attributes as feed station 24 (FIG. 1).

While not shown in FIG. 3, in some examples in which a substrate takes the form of separate sheets, it is understood that impression member 92 is capable of releasably securing media M to a surface of impression member 92 as media M passes through the pressure nip 98 so that media M is at least partially wrapped around impression member 92 at pressure nip 98. In some examples, the substrate is provided in the form of a web (W), as further described later in association with FIG. 11.

Moreover, it will be understood that impression member 92 is selectively movable relative to (i.e. toward or away from) intermediate transfer member 90 (as represented by directional arrow S in FIG. 3) to enable selective rolling engagement of the impression member 92 against the intermediate transfer member 90.

Figure 4A:
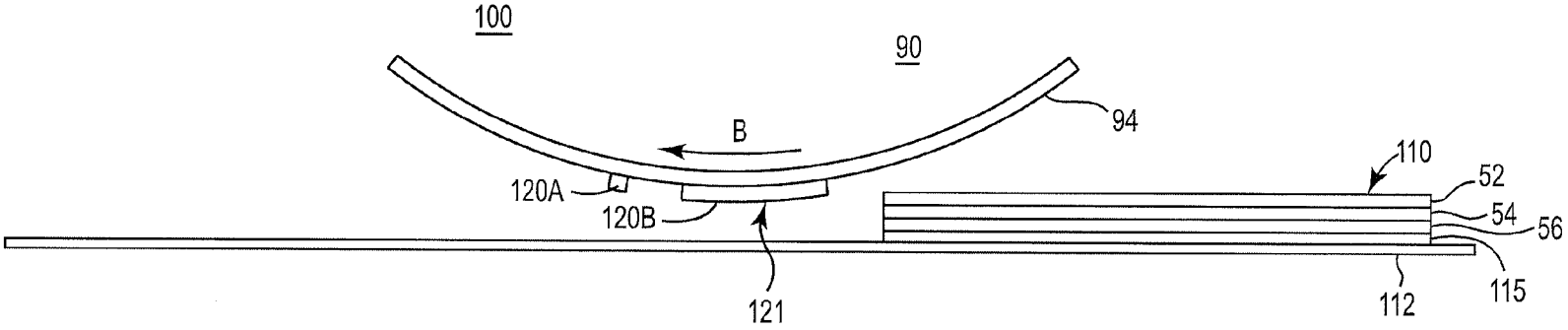
FIG. 4A is a side view schematically illustrating one aspect of pattern foil printing, according to one example of the present disclosure.

FIG. 4A is a diagram 100 including a sectional view schematically illustrating one aspect of pattern foil printing, according to one example of the present disclosure. As shown in FIG. 4A, a first patterned ink layer 121 has already been placed on intermediate transfer member 90 (i.e, transfer member 90 in FIG. 3), such as by first being formed as an image on a photoconductor member (e.g. imaging member 80 in FIG. 3) and then transferred onto the intermediate transfer member 90. As shown in FIG. 4A, the first patterned ink layer 121 has at least two portions 120A, 120B visible in the particular sectional view. It will be understood that because the overall pattern of the image formed by first ink layer 121 extends at least partially laterally across a length of the imaging member 80 and transfer member 90, other sectional views would reveal portions of first ink layer 121 having a different dimensions and different locations than portions 120A, 120B.

Figure 4B:
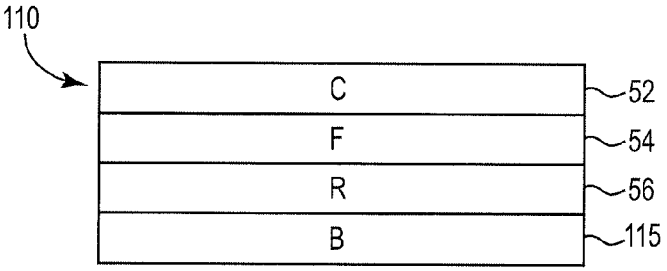
FIG. 4B is a side view schematically illustrating a foil assembly, according to one example of the present disclosure.

FIG. 4B provides an enlarged view of a foil assembly 110, according to one example of the present disclosure. As shown in FIG. 4B, foil assembly 110 includes a top coating layer (C) 52, foil layer (F) 54, release layer (R) 56, and backing layer (B) 115. The foil assembly 110 has substantially the same features and attributes as partial foil assembly 55, as previously described in association with FIG. 2, except further including backing layer 115.

As shown in FIG. 4A, in a method of printing, the foil assembly 110 is supported by carrier 112 which feeds the foil assembly 110 into contact with the rotating intermediate transfer member 90 according to a timing schedule such that the foil assembly 110 will become rollingly engaged by the first ink layer portions 120A, 120B on intermediate transfer member 90. In some examples, carrier 112 is incorporated within and/or defines feed station 24 (FIG. 1) and/or feed station 97 (FIG. 3).

In some examples, a feed mechanism for foil assembly 110 is at least partially defined by a surface of impression member 92 while in some examples, a feed mechanism for foil assembly 110 is defined by structures other than impression member 92. In some examples, such feed mechanisms include at least substantially the same features and attributes as feed station 24 (FIG. 1) and/or feed station 97 (FIG. 3).

Figure 5:
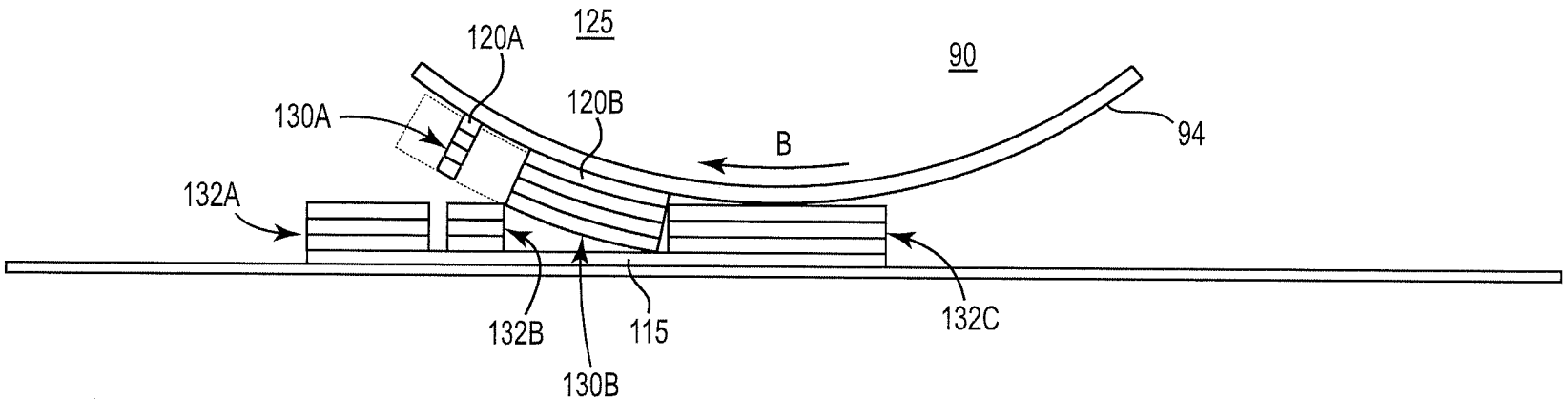
FIG. 5 is a side view schematically illustrating one aspect of pattern foil printing, according to one example of the present disclosure.

Upon this rolling engagement, as shown in the diagram 125 of FIG. 5, the top coating layer 52 of the foil assembly 110 becomes adhered to portions 120A, 120B of the first patterned ink layer 121, and as intermediate transfer member 90 continues to rotate away from carrier 112 (per directional arrow B), portions 130A, 130B of foil assembly 110 separate from the remaining portions 132A, 132B, 1320 of foil assembly 110 that remain on carrier 112. This separation occurs due to the adhesive force of first ink layer portions 120A, 120B against top coating layer 52 (and connected foil layer 54 and release layer 56) being greater than the ability of foil assembly 110 to withstand the resultant shearing action and due to the adhesive force of first ink layer portions 120A, 120B against top coating layer 52 being greater than the releasable adhesive force between the release layer 56 the backing layer 115.

In some examples, at least prior to or during the adhesive transfer of portions 130A, 130B of the foil assembly 110 to the first ink layer portions 120A, 120B, the temperature of the blanket of the intermediate transfer member 90 is heated to a temperature above the glass transition temperature of the adhesive (first ink layer 121) and at or below the melting temperature of the adhesive (first ink layer 121). In some examples, this heating is performed via heater 95 previously shown in FIG. 3.

As carrier 112 transports remaining portions 132A, 132B, 1320 away from intermediate transfer member 90, the intermediate transfer member 90 also continues rotating to carry the transferred portions 130A, 130B of foil assembly 110 toward further printing operations.

Figure 6A:
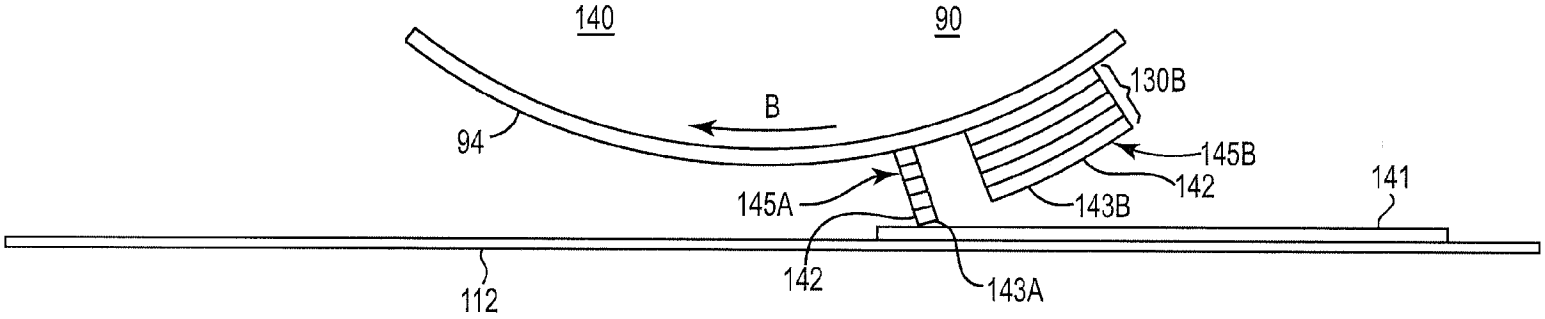
FIG. 6A is a side view schematically illustrating one aspect of pattern foil printing, according to one example of the present disclosure.

FIG. 6A is a diagram 140 including a sectional view schematically illustrating further aspects of pattern foil printing, according to one example of the present disclosure, that follow aspects of pattern foil printing described and illustrated in association with FIGS. 4A-5. As shown in FIG. 6A, after first being formed as an image on a photoconductor member 80 (FIG. 3), a second patterned ink layer 142 is transferred on top of the foil assembly portions 130A, 130B carried on intermediate transfer member 90, thus forming second ink layer portions 143A, 143B on top of release layer 56.

Figure 6B:
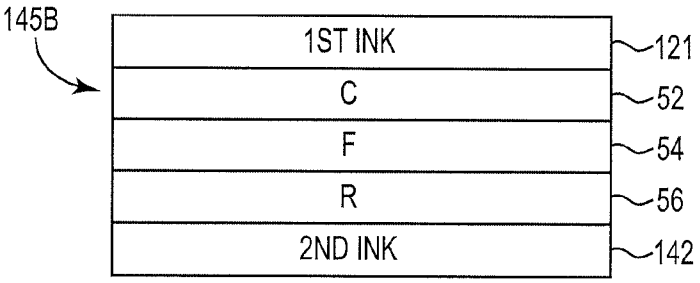
FIG. 6B is a side view schematically illustrating a partially printed product including a portion of a foil assembly, according to one example of the present disclosure.

As further shown in the enlarged sectional view of FIG. 6B, portion 145B (and portion 145A) comprises a compilation of first ink layer 121, coating layer 52, foil layer 54, release layer 56, and second ink layer portion 143B.

As shown in FIG. 6A, with the compilation portions 145A, 145B on intermediate transfer member 90, the intermediate transfer member 90 continues rotating (as represented via directional arrow B) while substrate 141 supported on carrier 112 is carried in the generally the same direction as which intermediate transfer member 90 is rotating until compilation portions 145A, 145B become engaged by substrate 141 such that the second ink layer portions 143A, 143B of each the respective compilation portions 145A, 145B become adhered to the substrate 141.

Figure 7:
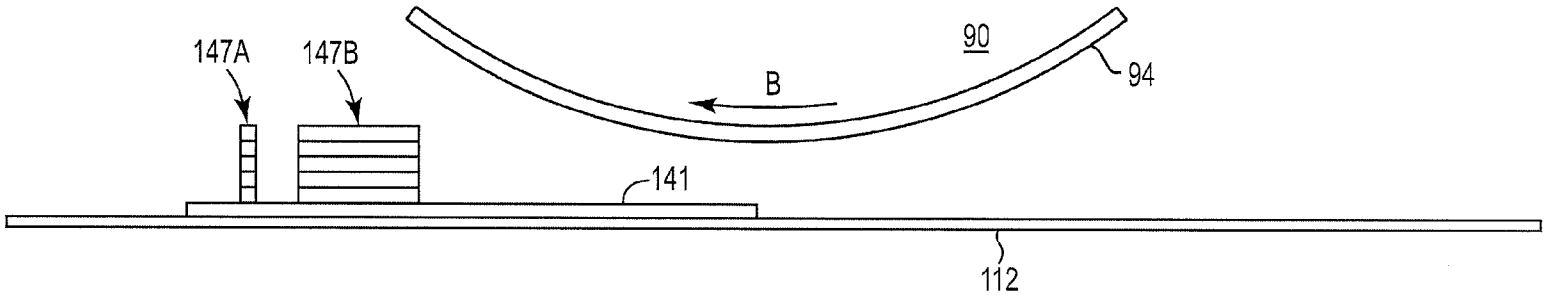
FIG. 7 is a side view schematically illustrating one aspect of pattern foil printing, according to one example of the present disclosure.

The resulting configuration is shown in FIG. 7, in which the compilation portions 145A, 145B have become transferred to and adhered to substrate 141, thereby effectively printing the foil layer 54 onto the substrate 141 (in the same pattern as at least the first ink layer 121).

Figure 8:
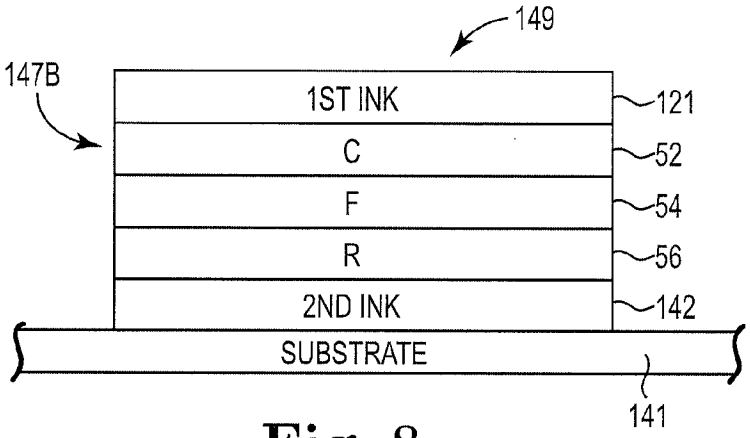
FIG. 8 is a side view schematically illustrating a partially printed product including a portion of a foil assembly, according to one example of the present disclosure.

At least a portion of the resulting printed product 149 is shown in the sectional/side view of FIG. 8, which shows the compilation 147B of layers, including first ink layer 121, coating layer 52, foil layer 54, release layer 56, and second ink layer 142 on substrate 141.

In some examples, the first ink layer 121 is formed as more than a single layer provided that the resulting compilation of layers defines an overall single pattern to which portions of the foil assembly will become adhered as part of the foil transfer methods in accordance with examples of the present disclosure. In this regard, in some examples, the term "first" in the phrase "the first layer" does not necessarily mean the first layer in time, but rather a layer (or compilation of layers) immediately preceding the transfer of the foil assembly onto the intermediate transfer member.

Similarly, in some examples, the term "second" in the phrase "the second ink layer" does not necessarily mean the second ink layer in absolute time, but refers to the ink layer immediately succeeding the transfer of the foil assembly onto the intermediate transfer member.

In some examples, the foil layer (F) 54 comprises a conductive element and is concealed via providing first ink layer 121 (FIG. 7B) as an opaque color and/or material. In some examples, the opaque color is white or a color generally matching the surface color of the final substrate 141.

Figure 9:
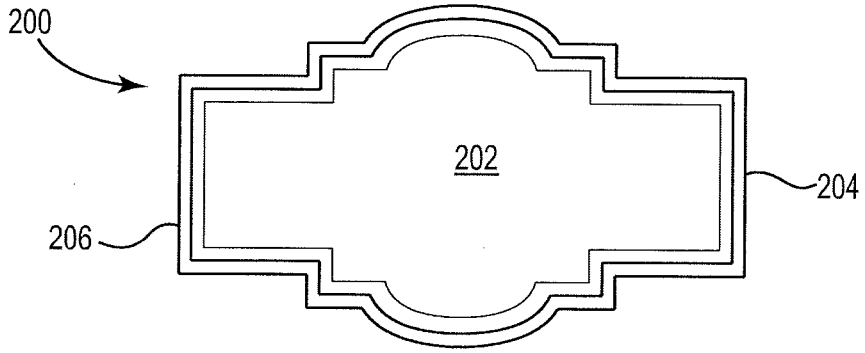
FIG. 9 is a top plan view schematically illustrating a printed product, according to one example of the present disclosure.

FIG. 9 is a top plan view of a printed product 200, according to one example of the present disclosure. In some examples, printed product 200 is printed according to at least some of the aspects of the examples of the present disclosure, as previously described in association with FIGS. 1-8. It will be understood that printed product 200 is just one example of many different types of printed products producible via the examples of the present disclosure.

As shown in FIG. 9, printed product 200 includes a body 202 with at least one border 204. In some examples, the at least one border 204 is formed via at least one layer formed from a metallic foil portion to give the border 204 a metallic, reflective appearance. In some examples, at least one ink layer overlays the foil portion defining the border 204. However, it will be understood that in some examples, the location of the metallic element(s) are not limited solely to the location of the border on the printed product and can be present at interior portions of body 202 in any desired pattern.

In some examples, the at least one ink layer (which overlies the at least partially metallic border 204) is transparent or translucent to permit visibility of the metallic element through the overlying ink layer. In some examples, the overlying ink layer is transparent or translucent and further includes color tinting to further enhance desired appearance characteristics of the metallic element defining border 204 or other feature.

In some examples, the at least one layer corresponds to the first ink layer 121 of the printed product shown in FIG. 8. In some examples, the at least one layer includes the first ink layer 121, but further includes additional ink layers that are printed on top of the first ink layer 121 after the transfer of the foil layer (F) 54 to the substrate has been completed in accordance with examples of the present disclosure as previously described in association with FIGS. 1-8.

In some examples, a printed product such as printed product 200 is printed on both sides, such as a front and back side via defining one side edge 206 as a foldable portion (e.g. like a hinge) wherein both the front and back sides are printed at one time, and then after printing, the label is folded at the foldable hinge and the two halves facing each other are joined to define a printed product having opposite front and back sides.

Figure 10:
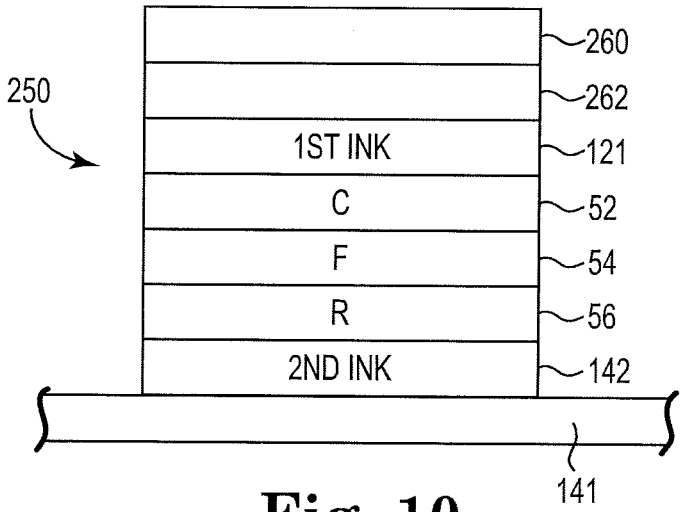
FIG. 10 is a side view schematically illustrating a partially printed product including a portion of a foil assembly, according to one example of the present disclosure.

FIG. 10 is a side view schematically illustrating that, after the foil assembly (including layers 52, 54, 56) are transferred onto the substrate 141, additional ink layers 260, 262 can be printed on top of the first ink layer 121 to complete formation of a printed image to add further color effects and/or to increase the opaqueness covering a hidden conductive portion (e.g. layer 54—F). It will be understood, as in previously described examples, that the thickness of the layers relative to the substrate is exaggerated for illustrative purposes.

Figure 11:
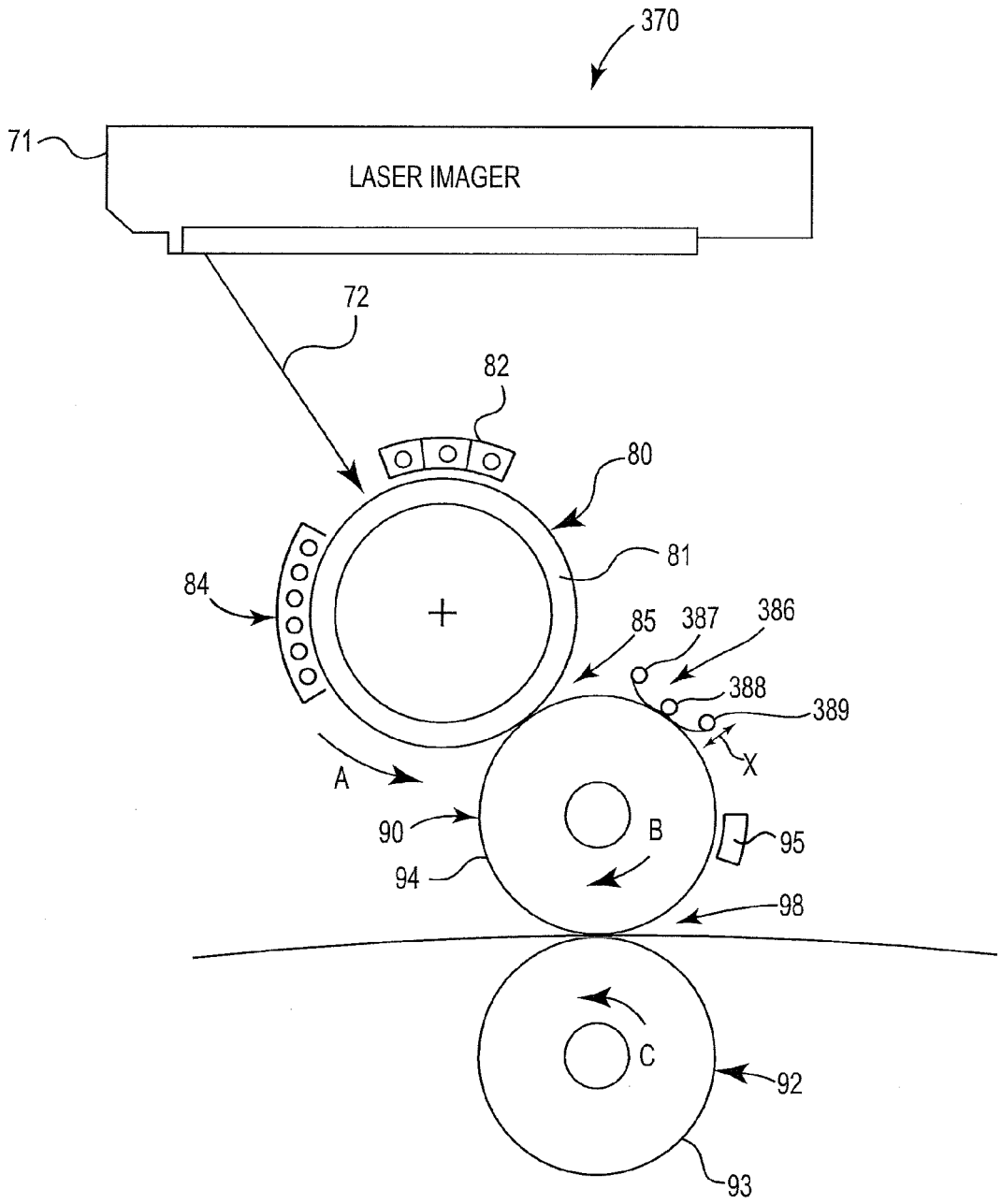
FIG. 11 is a diagram schematically illustrating a side view of a printer, according to one example of the present disclosure.

FIG. 11 is a block diagram schematically illustrating a printer 370, according to one example of the present disclosure. In some examples, printer 370 comprises at least substantially the same features and attributes as printers 20, 70 as previously described in association with FIGS. 1-3 and aspects of pattern foil printing as previously described in association with FIGS. 4A-10, except for printing onto a media web instead of separate sheets and including a dedicated foil feed station 386 adjacent the photoconductor member 80. In some examples, the feed station 386 comprises a roll-to-roll based mechanism to feed a foil assembly into contact relative to the intermediate transfer member 90. In some examples, the feed station 386 is interposed between the photoconductor member 80 and a heater 95 for heating the intermediate transfer member 90 at least prior to the nip. In some examples, heater 95 is omitted such that feed station 386 is interposed between the photoconductor member 80 and nip 98.

In some examples, the feed station 386 is selectively movable toward and away from intermediate transfer member 90 (as represented via directional arrow x) to selectively cause contact against, and spacing away from, the intermediate transfer member 90, respectively. When it is desired to adhere a segment of foil assembly (including a coating layer, foil layer, release layer) to an ink layer on intermediate transfer member 90, then at least a portion of the feed station 386 is advanced toward intermediate transfer member 90 to cause contact of the top coating layer of the foil assembly against the ink layer on the intermediate transfer member 90. The foil assembly (e.g. foil assembly 110 in FIG. 4B) is supplied from a supply roll 387 and brought into rolling contact, via pressing roller 388, against an ink layer on the intermediate transfer member 90. As the top coating layer 52 becomes adhered to the ink layer on the intermediate transfer member 90, a portion of the foil assembly (layers 52, 54, 56) separate from the backing layer 115 with the backing layer 115 remaining at feed station 386 and being taken up by a take-up roll 389.

After the portion of the foil assembly 110 becomes adhered to the ink layer on the intermediate transfer member 90, the feed station 386 is then moved to become spaced apart from the intermediate transfer member 90 in a storage position.

It will be understood that during the transfer of the foil assembly onto the intermediate transfer member 90 (via adhesion and selective removal of portions of the foil assembly to the first ink layer 121), the impression member 92 is disengaged relative to (and therefore spaced apart from) the intermediate transfer member 90 with web substrate not being in contact against the intermediate transfer member 90. However, after the second ink layer 142 is transferred on the foil assembly (on the intermediate transfer member 90), the impression member 92 re-engages against intermediate transfer member 90 to position the web substrate W to receive transfer of the foil assembly (via adhesion and contact of the second layer 142) onto the web substrate W.

Figure 12:
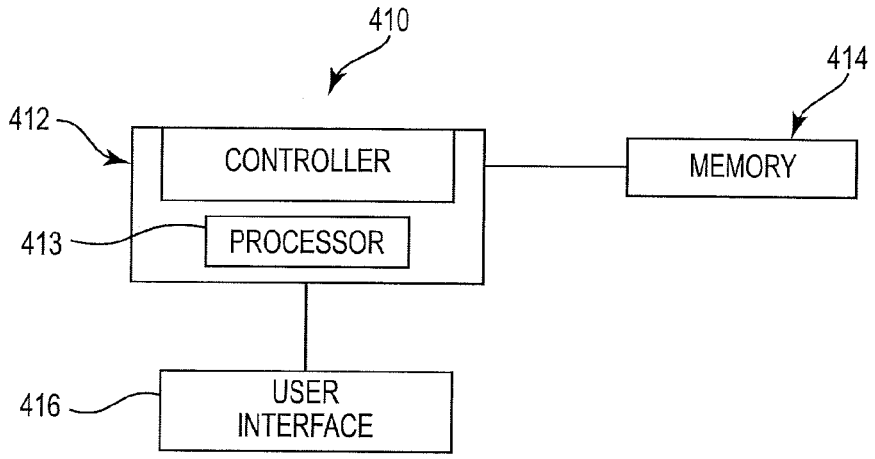
FIG. 12 is a block diagram schematically illustrating a control portion, according to one example of the present disclosure.

FIG. 12 is a block diagram schematically illustrating a control portion 410, according to one example of the present disclosure. In some examples, control portion 410 includes a controller 412, a memory 414, and a user interface 416.

In general terms, controller 412 of control portion 410 comprises at least one processor 413 and associated memories that are in communication with memory 414 to generate control signals directing operation of at least some components of the systems and components described throughout the present disclosure. In some examples, these generated control signals include, but are not limited to, digitally printing foil patterns. In some examples, a control portion 410 is present in the printer 20, 70, 370 of FIG. 1, 2, or 11, respectively, at which layers of ink are printed in patterns on an intermediate transfer member to capture a foil portion having a matching pattern and then transferring the compilation of ink layers and foil portion onto a substrate. Among other aspects, the control portion 410 controls the timing and sequence of printing of the ink layers relative to engagement with foil portions at the intermediate transfer member.

In particular, in response to or based upon commands received via a user interface 416 and/or machine readable instructions (including software), controller 412 generates control signals to perform the method of printing in accordance with at least some of the previously described examples and/or later described examples of the present disclosure. In one example, controller 412 is embodied in a general purpose computer while in other examples, controller 412 is embodied in the printers 20, 70, 370.

For purposes of this application, in reference to the controller 412, the term "processor" shall mean a presently developed or future developed processor (or processing resources) that executes sequences of machine readable instructions (such as but not limited to software) contained in a memory. In some examples, execution of the sequences of machine readable instructions, such as those provided via memory 414 of control portion 416 cause the processor to perform actions, such as operating controller 412 to perform patterned foil printing as generally described in (or consistent with) at least some examples of the present disclosure. The machine readable instructions may be loaded in a random access memory (RAM) for execution by the processor from their stored location in a read only memory (ROM), a mass storage device, or some other persistent storage (e.g., non-transitory tangible medium or non-volatile tangible medium, as represented by memory 414. In one example, memory 414 comprises a computer readable tangible medium providing non-volatile storage of the machine readable instructions executable by a process of controller 412. In other examples, hard wired circuitry may be used in place of or in combination with machine readable instructions (including software) to implement the functions described. For example, controller 412 may be embodied as part of at least one application-specific integrated circuit (ASIC). In at least some examples, the controller 412 is not limited to any specific combination of hardware circuitry and machine readable instructions (including software), nor limited to any particular source for the machine readable instructions executed by the controller 412.

In some examples, user interface 416 comprises a user interface or other display that provides for the simultaneous display, activation, and/or operation of at least some of the various components, functions, features, and of control portion 410 and/or printer 20, 70, 370, as described throughout the present disclosure. In some examples, at least some portions or aspects of the user interface 416 are provided via a graphical user interface (GUI).

Figure 13:
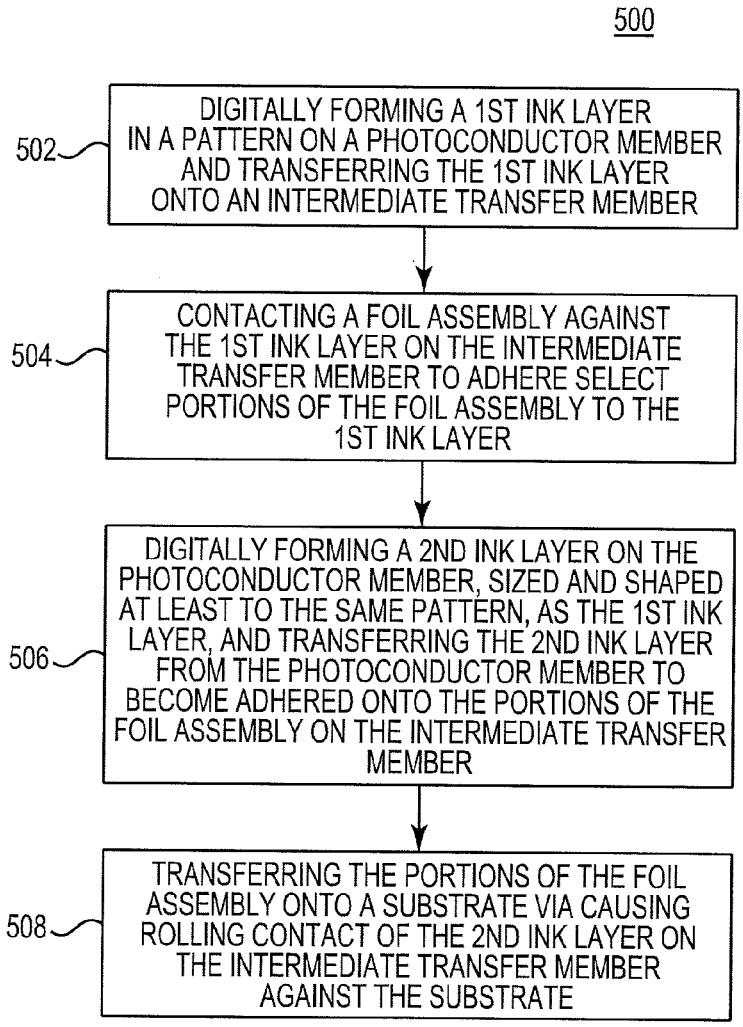
FIG. 13 is a flow diagram schematically illustrating a method of printing, according to one example of the present disclosure.

FIG. 13 is a flow diagram schematically illustrating a method 500 of printing, according to one example of the present disclosure. In some examples, the method 500 is performed via employing the components, systems, modules, portions, etc. as previously described in association with FIGS. 1-12. In some examples, method 500 is performed via employing the components, systems, modules, portions, etc. other than those previously described in association with FIGS. 1-12.

As shown at 502 in FIG. 13, in some examples method 500 includes digitally forming a first ink layer in a pattern on a photoconductor member and transferring the first ink layer onto an intermediate transfer member. As shown at 504, method 500 includes contacting a foil assembly against the first ink layer on the intermediate transfer member to cause select portions of the foil assembly to become adhered to the first ink layer. In one aspect, the patterned portion (i.e. the adhered portions) of the foil assembly has a shape matching the pattern of the first ink layer. In some examples, the foil assembly includes a multi-layer assembly including a foil layer sandwiched between other layers, such as a release layer and coating layer, and may include a backing layer against the release layer.

As shown at 506, method 500 further includes digitally forming a second ink layer, on the photoconductor member, according to the same pattern as the first ink layer and transferring the second ink layer from the photoconductor member to become adhered onto the patterned portion of the foil assembly on the intermediate transfer member. As shown at 508, method 500 includes transferring the patterned portion of the foil assembly, via rolling contact of the second ink layer on the intermediate transfer member against a substrate, onto the substrate.

At least some examples of the present disclosure are directed to digital printing of conductive and/or metallic foil elements such that the application of the conductive and/or metallic foil elements occurs as part of the printing process and not as part of a post-printing operation as occurs in traditional techniques.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A liquid electrophotographic printer comprising:

an image formation portion to transfer first and second patterned ink layers formed on a photoconductor member onto an intermediate transfer member, which is rollingly engaged relative to the photoconductor member, wherein the second patterned ink layer covers at least an area of the first patterned ink layer;

a feed portion to direct at least a portion of a foil layer to become adhered onto the first patterned ink layer on the intermediate transfer member before the second patterned ink layer is transferred onto, and becomes adhered to, the portion of the foil layer according to the pattern, by which the first and second patterned ink layers and the portion of the foil layer together comprise a first assembly; and a transfer portion to cause transfer of the first assembly, including the portion of the foil layer, from the intermediate transfer member, via transfer of at least the second patterned ink layer from the intermediate transfer member, onto a substrate, wherein the feed portion is located adjacent the intermediate transfer member between the photoconductor member and the transfer portion.

2. The printer of claim 1, comprising:

a control portion to control operation of the image formation portion and positioning of the intermediate transfer member to cause the first patterned ink layer to be transferred to the intermediate transfer member before formation of the second patterned ink layer on the photoconductor member.

3. The printer of claim 2, wherein the feed portion includes a supply of foil assembly including a backing layer, a release layer, the foil layer, and a top adhesive layer, wherein the feed portion delivers the top adhesive layer of the foil assembly into contact with the first patterned ink layer on the intermediate transfer member to cause the release layer of the foil assembly to define an uppermost layer of the foil assembly while on the intermediate transfer member.

4. The printer of claim 3, wherein the control portion controls the timing of the photoconductor member to cause the second patterned layer to be formed and transferred to the intermediate transfer member on top of the release layer on the intermediate transfer member, the second patterned layer defining the uppermost layer of a compilation of layers formed on the intermediate transfer member.

5. The printer of claim 1, wherein the image formation portion comprises the photoconductor member, a charging station, a light exposure station, an ink development station, and wherein the intermediate transfer member is rollingly engageable against, and forms a first nip, relative to the photoconductor member.

6. The printer of claim 1, wherein the substrate comprises a generally continuous web, and wherein the feed portion is positioned adjacent the intermediate transfer member and interposed between the photoconductor member and the transfer portion.

7. The printer of claim 1, wherein the respective first and second patterned ink layers comprise first and second patterned adhesive ink layers.

8. A liquid electrophotographic printer, comprising:

an image formation portion to transfer first and second patterned ink layers formed on a photoconductor member onto an intermediate transfer member, wherein the second ink layer covers at least an area of the first patterned ink layer, wherein the image formation portion comprises the photoconductor member, a charging station, a light exposure station, an ink development station, and wherein the intermediate transfer member is rollingly engageable against, and forms a first nip, relative to the photoconductor member;

a feed portion to direct a portion of a conductive foil layer to become adhered, according to the pattern, onto the first patterned ink layer on the intermediate transfer member before the second patterned ink layer is transferred onto, and becomes adhered to, the foil portion according to the pattern, by which the first and second patterned ink layers and the portion of conductive foil layer together comprise a first assembly; and a transfer portion to cause transfer of the first assembly, including the portion of the conductive foil layer, from the intermediate transfer member, via transfer of at least the second patterned ink layer from the intermediate transfer member, onto a substrate, wherein the transfer portion includes an impression member to be in selective rolling engagement against, and form a second nip relative to, the intermediate transfer member, wherein the feed portion includes a station positioned adjacent the second nip to feed a foil assembly sheet including the conductive foil layer to become adhered relative to the first patterned ink layer on the intermediate transfer member, and wherein the impression member is spaced apart from the intermediate transfer member when the foil assembly sheet is brought into engagement relative to the first patterned ink layer on the intermediate transfer member.

9. A method printing comprising:

digitally forming a first marking agent layer in a pattern on a photoconductor member and transferring the first marking agent layer onto an intermediate transfer member;

contacting an unpatterned foil assembly against the first marking agent layer on the intermediate transfer member to cause a portion of the foil assembly to become adhered to the first marking agent layer, wherein the adhered portion of the foil assembly defines a patterned portion having a shape matching the pattern of the first marking agent layer;

digitally forming a second marking agent layer, on the photoconductor member, covering at least an area of the same pattern as the first marking agent layer and transferring the second marking agent layer from the photoconductor member to become adhered onto at least the patterned portion of the foil assembly on the intermediate transfer member, by which the patterned first marking agent layer, the patterned foil assembly, and the second marking agent layer become arranged as a first assembly; and transferring the first assembly, including the patterned portion of the foil assembly, via rolling contact of the second marking agent layer on the intermediate transfer member against a substrate, onto the substrate, wherein the substrate comprises a single sheet, and wherein contacting the unpatterned foil assembly comprises:

feeding the foil assembly at a nip of the intermediate transfer member and an impression member to produce a formed compilation of the first marking agent layer and a patterned foil layer of the foil assembly on the intermediate transfer member, wherein feeding the foil assembly is performed before digitally forming the second marking agent layer.

10. The method of claim 9, wherein the marking agent comprises a liquid electro-ink and the printing is performed via liquid electrophotography.

11. A method of printing comprising:

digitally forming a first marking agent layer in a pattern on a photoconductor member and transferring the first marking agent layer onto an intermediate transfer member;

contacting an unpatterned foil assembly against the first marking agent layer on the intermediate transfer member to cause a portion of the foil assembly to become adhered to the first marking agent layer, wherein the adhered portion of the foil assembly defines a patterned portion having a shape matching the pattern of the first marking agent layer;

digitally forming a second marking agent layer, on the photoconductor member, covering at least an area of the same pattern as the first marking agent layer and transferring the second marking agent layer from the photoconductor member to become adhered onto at least the patterned portion of the foil assembly on the intermediate transfer member, by which the patterned first marking agent layer, the patterned foil assembly, and the second marking agent layer become arranged as a first assembly; and transferring the first assembly, including the patterned portion of the foil assembly, via rolling contact of the second marking agent layer on the intermediate transfer member against a substrate, onto the substrate, wherein the substrate comprises a web, and wherein contacting the unpatterned foil assembly comprises:

feeding the foil assembly from a roller-feed assembly that is releasably engageable against the intermediate transfer member adjacent a nip between the intermediate transfer member and photoconductor member.

12. The method of claim 11, comprising:

interposing the roller-feed assembly between the photoconductor member and a heater to apply heat onto the respective patterned layers on the intermediate transfer member.

13. The method of claim 11, wherein the marking agent comprises a liquid electro-ink and the printing is performed via liquid electrophotography.

14. A liquid electrophotographic printer comprising:

an image formation portion including a photoconductor member and an intermediate transfer member to receive transfer of at least a first ink layer in a first pattern from the photoconductor member;

a feed portion to direct a foil portion to become adhered, according to the first pattern, onto the first ink layer on the intermediate transfer member such that the foil portion and the first ink layer together at least partially define a first assembly having the first pattern; and a transfer portion to cause transfer of at least the first assembly, including the foil portion, from the intermediate transfer member onto a substrate, wherein the feed portion is located adjacent the intermediate transfer member between the photoconductor member and the transfer portion.

15. The printer of claim 14, wherein the substrate comprises a generally continuous web and wherein the feed portion comprises a roller-feed assembly selectively, releasably engageable relative to the intermediate transfer member.

16. The printer of claim 14, wherein the substrate comprises a sheet and wherein the feed portion is located adjacent an interface of the intermediate transfer member and the transfer portion.

17. The printer of claim 14, in which the photoconductor member is to form a second ink layer in a second pattern for transfer onto the foil assembly on the intermediate transfer member to produce a formed compilation of the respective first and second ink layers and foil portion on the intermediate transfer member, and the intermediate transfer member is to transfer the formed compilation, via the second ink layer, onto the substrate at the transfer portion, wherein the second pattern of the second ink layer covers at least an area of the first pattern first ink layer.

18. The printer of claim 14, wherein the image formation portion comprises the photoconductor member, a charging station, a light exposure station, an ink development station, and wherein the intermediate transfer member is rollingly engageable against, and forms a first nip, relative to the photoconductor member.

* * * * *